US005265651A

United States Patent [19]

Perkins et al.

[11] Patent Number: 5,265,651

[45] Date of Patent: Nov. 30, 1993

[54] FOAM REDUCTION OF VAPOR EMISSIONS FROM STORAGE TANKS

[75] Inventors: Thomas K. Perkins; Sophany Thach, both of Dallas, Tex.

[73] Assignee: Atlantic Richfield Company, Los Angeles, Calif.

[21] Appl. No.: 887,941

[22] Filed: May 26, 1992

[51] Int. Cl.[5] ..... B65D 88/46

[52] U.S. Cl. ..... 141/1; 141/11; 141/69; 141/98; 220/902; 220/222; 220/219

[58] Field of Search ..... 141/1, 11, 69, 98; 220/218, 902, 222, 221, 224, 226, 219

[56] References Cited

U.S. PATENT DOCUMENTS 3,850,206 11/1974 Canevari et al. ..... 141/1
4,148,361 4/1979 Christensen ..... 220/88.3 X
4,260,068 4/1981 McCarthy et al. ..... 220/221
4,648,968 3/1987 Cutler ..... 220/224 X
5,054,526 10/1991 Perkins ..... 141/1
5,125,439 6/1992 Perkins ..... 141/11

*Primary Examiner*—Ernest G. Cusick
*Attorney, Agent, or Firm*—Michael E. Martin

[57] ABSTRACT

Floating roof storage tanks are modified to include a foam surge tank, a low-pressure blower and a foam generator for generating vapor-suppressing foam during withdrawal of liquid from the storage tank and after the floating roof reaches its lowest elevation in the storage tank so that the tank space previously occupied by volatile liquid is provided with a vapor-suppressing foam blanket during liquid withdrawal and refill. The surge tank is mounted directly on the floating roof and discharges its foam through an opening in the roof into the tank storage space. During liquid refill the foam may be forced out through a vent conduit onto the roof of the tank and dissolved and recovered.

18 Claims, 3 Drawing Sheets

FOAM REDUCTION OF VAPOR EMISSIONS FROM STORAGE TANKS

BACKGROUND OF THE INVENTION

1. Field of the Invention

The present invention pertains to a method and system for reducing vapor emissions from floating roof storage tanks for petroleum liquids using a vapor-suppressing foam.

2. Background

Floating roof type storage tanks are commonly used to store petroleum liquids to minimize the generation of vapors and alleviate problems associated with venting the tanks during filling and emptying. However, floating roof type storage tanks typically include some fixed interior space which is created when the floating roof descends to its minimum height dictated by support legs which are typically connected to the roof or extend upward from the tank bottom. In order to minimize the generation of vapors during a change of the type of liquid stored in a conventional floating roof tank, the interior tank space created by the displacement of one petroleum liquid during emptying is taken up by pumping water into the tank. When the new and different petroleum liquid is pumped into the tank, the water is displaced from the tank and must then be treated to remove petroleum contaminants and otherwise render the water suitable for disposal. A typical floating roof type storage tank may generate as much as one hundred thousand (100,000) cubic feet of waste water during the changeover from one type of liquid previously stored to the new liquid to be stored.

One promising and desirable method of minimizing the generation of vapors in the handling and storage of petroleum liquids pertains to the use of a foam which may be placed on top of the liquid being stored or may be pumped into the tank space to be occupied by the liquid to prevent the generation and accumulation of volatile and hazardous vapors. U.S. patent application Ser. No. 07/653,398, filed Feb. 11, 1991 in the name of Thomas K. Perkins and assigned to the assignee of the present invention, describes a method for controlling vapor emissions during the loading of marine tankers with hydrocarbon liquids wherein a blanket of aqueous foam is placed in the fixed volume compartments of the tanker to form a barrier between the hydrocarbon liquid and the tank space above the liquid to minimize the generation of volatile vapors in the tank compartments. U.S. Pat. No. 3,850,206 describes an earlier method of introducing a vapor-suppressing foam to tanker cargo tanks.

The present invention eliminates the need to handle large volumes of hazardous waste water generated in the change of liquids in floating roof type storage tanks using a type of foam similar to that described in the abovementioned patent and patent applications. Certain improvements in foam composition such as described in U.S. patent application Ser. No. 07/584,978, filed Sep. 19, 1990 in the name of Sophany Thach et al, and assigned to the assignee of the present invention, and also as described in International Patent Application Number PCT/US 91/06795 also assigned to the assignee of the present invention may also be used with the method and system of the present invention.

SUMMARY OF THE INVENTION

The present invention provides a unique method for minimizing the generation of vapors in floating roof type storage tanks, particularly tanks used to store petroleum liquids and the like.

The present invention also provides an improved floating roof storage tank having means for generating and displacing into the tank space a vapor-suppressing foam to minimize the generation of volatile vapors during emptying and filling of the tank with volatile liquids such as crude and refined petroleum.

In accordance with one important aspect of the present invention, the generation of large amounts of hazardous waste water are eliminated by introducing into a floating roof storage tank a foam material which occupies the tank spaces when a complete change-out of the liquid stored in the tank is conducted. The tank space created when the floating roof reaches its lowest position during liquid removal or changeover is filled with a vapor-suppressing foam which is introduced into the tank space through a unique tank modification including a surge chamber or tank disposed on the floating roof.

In accordance with another aspect of the present invention, a vapor-suppressing foam is introduced into the tank space of a floating roof storage tank during liquid removal from and introduction into the tank space by a unique method which includes introduction of the foam into the tank space under a positive pressure from a pressure air source. The pressure air source may be a low-pressure, large volume blower mounted on the tank roof or otherwise disposed in proximity to the tank. A long-lasting aqueous foam material is generated which forms a barrier to the generation of volatile vapors and occupies the tank spaces which would otherwise fill with vapors and which would then be required to be vented when the tank is filled with liquid.

Those skilled in the art will recognize the above-described features and advantages of the present invention, together with other superior aspects thereof, upon reading the detailed description which follows in conjunction with the drawing.

DESCRIPTION OF PREFERRED EMBODIMENTS

Figure 1:
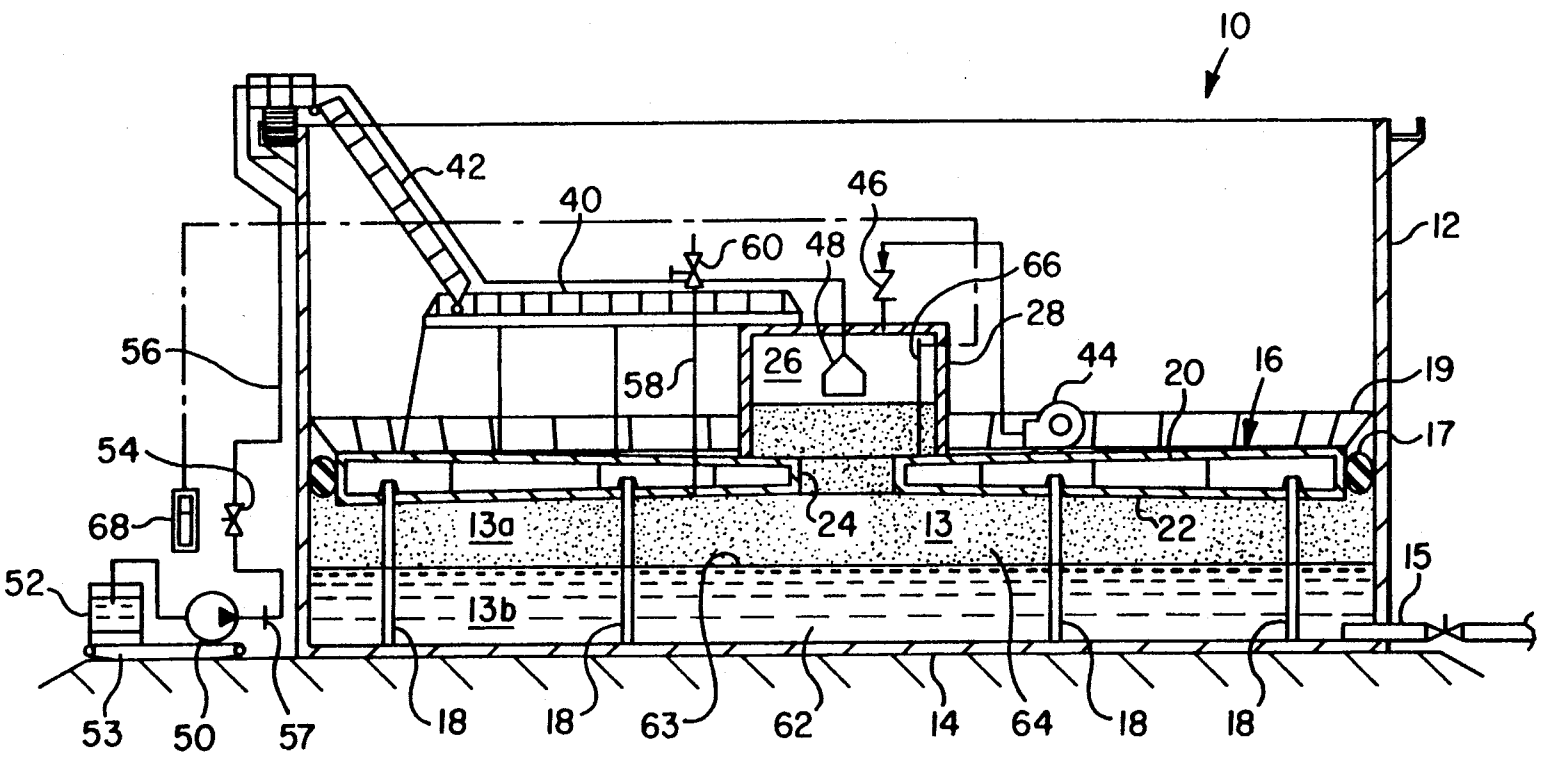
FIG. 1 is a vertical central section view, in somewhat schematic form, of a floating roof storage tank modified in accordance with the present invention.

In the description which follows, like parts are marked throughout the specification and drawing with the same reference numerals, respectively. The drawing figures are not to scale in the interest of clarity and conciseness.

Referring to FIG. 1, there is illustrated a floating roof type storage tank, generally designated by the numeral 10, of the type typically used for storing large volumes of crude and refined petroleum liquids, for example. The tank 10 is characterized by a generally cylindrical outer wall or shell 12, a substantially flat bottom plate 14 and a floating roof, generally designated by the numeral 16. The floating roof 16 is shown in a position in both FIGS. 1 and 2 wherein the roof has descended to its lowest position as determined by upstanding roof support legs 18. The support legs 18 prevent the roof 16 from descending to the bottom 14 which would prevent suitable filling of the tank and would damage liquid fill and drain conduits, not shown in their entirety. The legs 18 may be connected to the roof 16 or be secured to the bottom 14 of the tank and extend upwardly for engagement with the roof as the liquid level in the tank drops. Alternatively, the tank wall 12 may also be modified to have suitable means for engaging and supporting the roof as it descends to the position illustrated in FIGS. 1 and 2.

The roof 16 is illustrated to be of the so-called double deck type having upper and lower deck plates 20 and 22, respectively. The roof 16 has been modified to have a generally cylindrical central opening 24 formed therein which opens into the interior space 26 of a foam generating and surge tank 28 which is mounted on the roof 16. The tank 28 may be of conventional construction comprising a generally cylindrical structure or of any suitable configuration which will provide the interior space 26 for generating vapor-suppressing foam which may then flow through the opening 24 into the interior space 13 of the tank 10, which space is delimited by the underside of roof 16, the tank wall 12 and the bottom 14.

Although the floating roof 16 is illustrated as being of the double deck type, other types of floating roofs may also be modified to have a suitable opening formed therein together with a foam generator or surge tank 28 associated therewith. For example, pan roof, pontoon roof and internal roof type storage tanks may also be modified to be used in accordance with the method and system of the present invention. The double deck roof 16 includes a conventional tank wall seal 17 formed on the periphery thereof and also a wall-contacting weather shield 19, provided to minimize or prevent the venting of vapors from the space 13 to atmosphere and to prevent the entry of rain or snow into the tank space 13. Conventional rain water drain apparatus for the roof 16 is omitted from the drawing in the interest of clarity. The tank 10 is also provided with a manway or catwalk and movable stairway arrangement 40, 42 to provide access to the floating roof 16 from the exterior of the tank. A conventional exterior stairway to provide access to the stairway 42 is not illustrated in FIGS. 1 or 2. The catwalk 40 and stairway 42 are of generally conventional construction and arrangement with respect to floating roof type storage tanks with the exception that the location of the catwalk 40 has been modified to permit access to the top of the foam surge tank 28, as illustrated.

Figure 2:
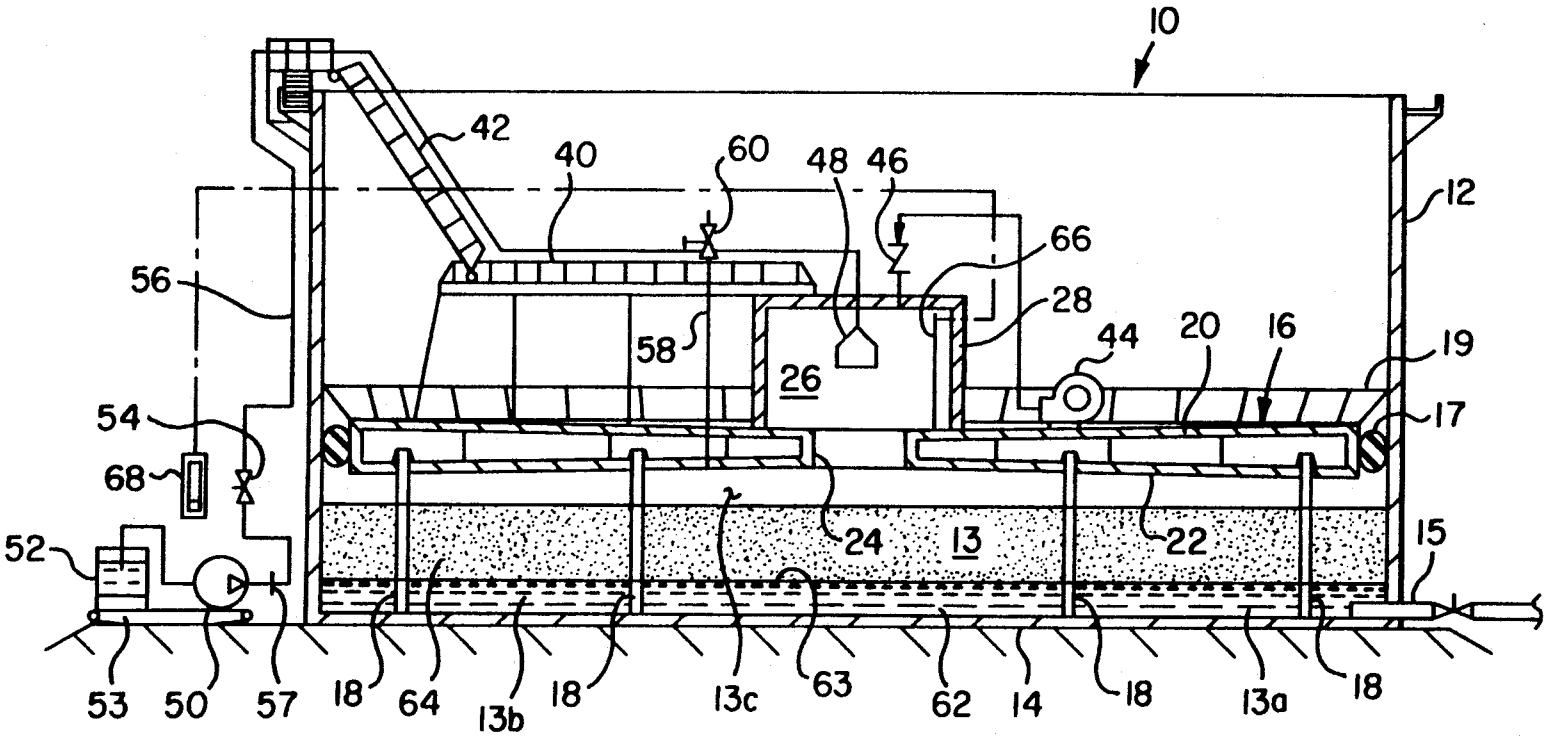
FIG. 2 is a view similar to FIG. 1 showing a lower level of liquid in the storage tank.

Referring further to FIGS. 1 and 2, the storage tank 10 is also provided with means for generating positive pressure (that is exceeding ambient atmospheric pressure) within the spaces 13 and 26 comprising a pump or blower 44 which is connected by way of a check valve 46 with the space 26 to provide large volumes of low-pressure air to the spaces 26 and 13. A foam generator 48 is disposed for generating foam to enter the space 26 as well as the space 13 in a manner to be described further herein. The generator 48 is in communication with a source of foam-generating liquid comprising a pump 50 and a storage tank 52. A suitable control valve 54 is interposed in a conduit 56 between the pump 50 and the foam generator 48 for controlling the rate of foam generation within the space 26. A quick disconnect coupling 57 is adapted to connect the conduit 56 to the pump 50. The foam generator 48 may be of a conventional type such as shown and described in a treatise entitled *Foam Systems and Components for Fire Protection, Spill Mitigation, Dust and Fume Control*, MSA Research Corporation, Pittsburgh, Pa., January, 1990. The foam generator 48 may also be generally of the type described in a Statutory Invention Registration entitled "A Method and Apparatus for Supplying Foam to Tanks" and based on U.S. patent application Ser. No. 07/807,486, filed Dec. 16, 1991 and assigned to the assignee of the present invention. The source of foam liquid comprising the pump 50 and tank 52 may be mounted on a suitable portable skid or trailer 53 and thereby movable from tank to tank when it is necessary to generate foam in accordance with the present invention. FIGS. 1 and 2 also show a conduit 58 in communication with the tank interior space 13 and with atmosphere above the roof 16. A suitable valve 60 is interposed in the conduit 58 to place the tank space 13 in communication with the atmospheric space above the roof 16 to vent foam from the tank space as needed.

FIG. 1 illustrates the condition wherein the floating roof 16 has descended to a position within the tank wherein it is supported by the support legs 18 and will descend no further in the tank. FIG. 1 also illustrates a certain amount of petroleum liquid 62 still in the tank space 13 and dividing the space 13 into spaces 13*a* above the liquid interface 63 and a space 13*b* occupied by the liquid 62. FIG. 1 also shows the condition wherein a substantial amount of foam 64 has been generated and fills the space 13*a* between the liquid interface 63 and the lower deck 22 of the roof 16. Some of the foam 64 is still in the surge tank 28 and occupies part of the space 26.

As liquid 62 is withdrawn from the tank 10 through a suitable outlet conduit 15, for example, and the roof 16 descends to the position illustrated in FIGS. 1 and 2, foam is generated within the surge tank 28 so that as the liquid begins to drop below the lower deck 22, foam flows through the opening 24 into the space 13*a* to occupy that space as it grows in volume to prevent the formation of vapors in the space 13*a* due to evaporation of volatile components of the liquid 62, for example. Foam is generated at a rate to replace the liquid 62 as it is withdrawn from the bottom of the tank 10 in such a way that the pressure within the space 13*a* is maintained at least equal to or greater than atmospheric pressure so that there is no tendency for atmospheric air to leak past the seal 17 into the space 13*a*.

It is contemplated that merely generating foam in the space 26 at a sufficient rate will create a net positive pressure which will cause the foam to flow into the space a as that space grows in volume. However, the rate of liquid withdrawal from the tank 10 may be excessive and make it impossible to maintain a positive static pressure "head" of foam 64 as it tries to flow through the opening 24 and out into the space 13*a* to cover the entire liquid interface 63. The rate of foam flow into the tank space 13*a* may be enhanced by operation of the low-pressure blower 44 to increase the air pressure in the space 26 above the foam 64 and force the foam through the opening 24 out into all of the space 13*a*.

Figure 3:
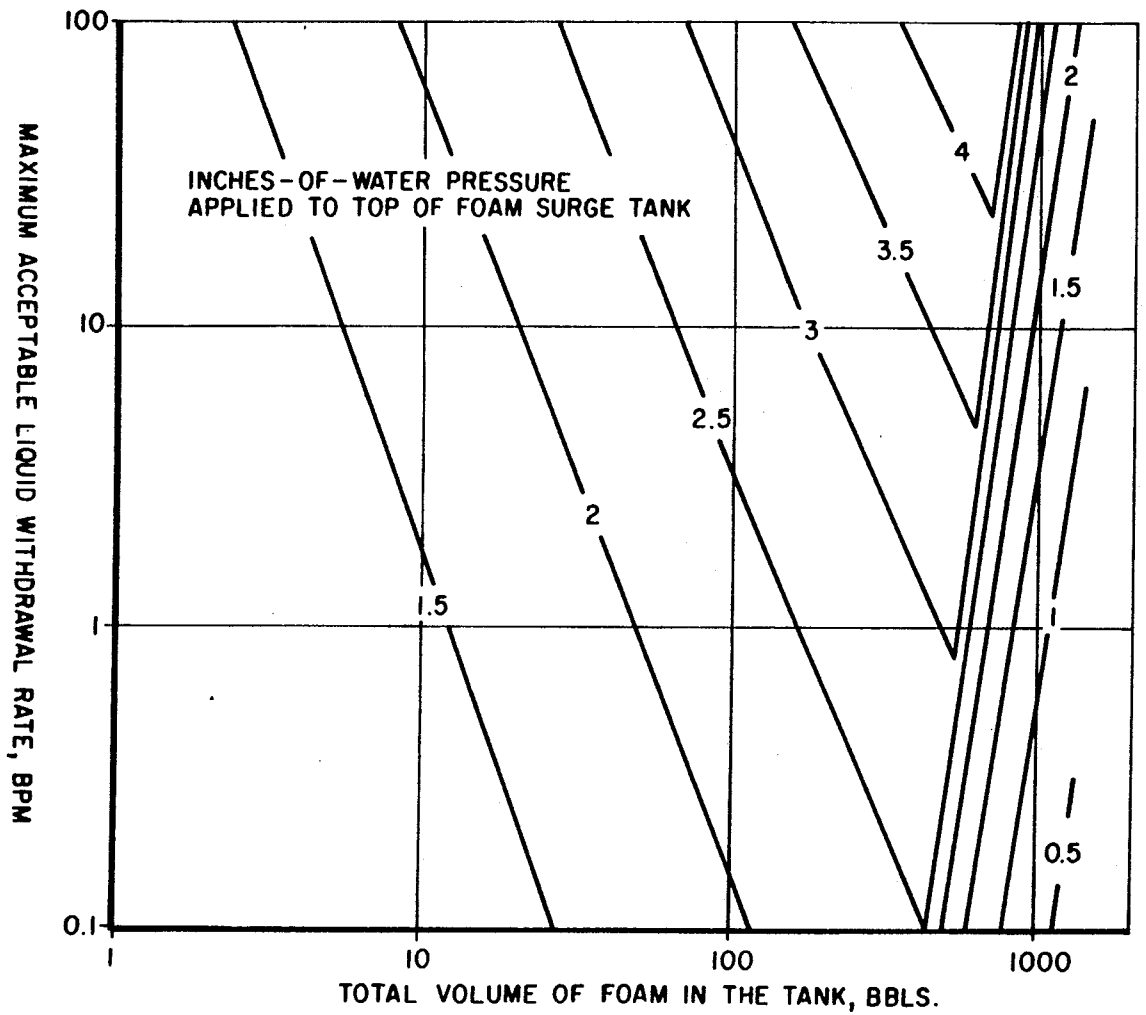
FIG. 3 is a diagram showing the maximum withdrawal rate of liquid from a typical large liquid storage tank versus the total volume of foam in the tank and the pressure acting on the foam at various conditions.

FIG. 3 illustrates liquid withdrawal rates (in petroleum barrels per minute, BPM) that may be conducted from a conventional floating roof liquid storage tank of approximately 146 ft. diameter based on selected pressures (in inches of water column) applied by the blower 44 on top of the foam 64 in the tank space 26. Thanks to the provision of the blower 44, the tendency for creation of a vacuum condition under the seal 17 and within the space 13*a* will be minimal. Moreover, the generation of foam by the foam generator 48 within the surge tank space 26 is not adversely affected by pressurization of the space from the blower 44. During generation of foam 64 to occupy the space 13*a* the valve 60 would, of course, be closed so that foam would not be forced out of the space 13*a* through the conduit 58. In order to prevent the level of foam 64 in the space 26 from decreasing below the bottom of the surge tank 28 and introduction of pressure air into the space 13*a*, prematurely, a foam level sensor 66 is provided in the space 26 and is suitably connected to a level indicator 68 which may be read by an operator of the foam generating system characterized by the generator 48, the pump 50, the tank 52 and the control valve 54.

The foam level sensor 66 may, for example, comprise two metal plates installed within the space 26 several inches apart and suitably connected to an ohmmeter which may be calibrated in the depth of the space 26 and comprise the basic characteristic of the indicator 68. Electrical conductivity between the aforementioned plates would be proportional to the depth of the foam in the space 26.

As previously mentioned, the generation of foam 64 within the tank 28 is not significantly affected by pressurization of the tank space 26. Air entering the tank space 26 from the blower 44 may be circulated within the tank 28 to create foam and the pressure or delivery rate of air from the blower 44 automatically adjusts to balance the rate of liquid withdrawal from the space 13. This adjustment of pressure and flow rate is relatively easily accomplished with a conventional centrifugal type low-pressure air blower 44.

Floating roof storage tanks may be modified to include the surge tank 28 and a suitable source of low-pressure, high-volume air such as blower 44. Of course, newly constructed tanks may have their floating roofs constructed in accordance with the general features illustrated in the drawing and described hereinabove. Existing or newly constructed tanks would also be fitted with a foam level sensor 66 and a conduit 56 and foam generator 48 for connection to a source of foam solution such as the portable pump and tank unit 50, 52.

When volatile liquid is removed from the tank 10 to the point wherein the floating roof 16 has reached its lowest position, the foam generator 48 is activated to generate foam to a depth equal to the minimum acceptable in the surge tank 28 as controlled by the generator and read by the operator at the indicator 68. Foam is added to the space 26 until the maximum desirable depth of foam 64 in the space is reached and the blower 44 is then started to pressurize the interior of the surge tank 28. Liquid 62 may continue to be withdrawn or withdrawal is restarted and liquid is allowed to flow out at a rate which maintains a suitable level of foam 64 in the surge tank 28 as foam flows into the space 13*a* to occupy that space and prevent the accumulation of vapors therein. If the rate of foam generation is matched to the desired rate of liquid withdrawal, there will be no need to continuously adjust the foam generation rate and it would be possible to continuously generate foam 64 at the same rate that liquid was being withdrawn. The foam level in the surge tank 28 may be maintained in an acceptable range by manually throttling the delivery of the foam solution from the pump 50, for example.

When a sufficient amount of foam 64 has been injected into the space 13*a* to give a desired thickness of a foam layer or blanket, as indicated in FIG. 2, the blower 44 may be turned off to allow the foam to expand in the space 13*a*. Expansion in the range of about 1.5% of the volume of the space 13*a* may be permitted by further withdrawal of liquid without causing foam to back up through the space 26 and the blower discharge conduit, although this may be minimized by the check valve 46, and without causing the pressure in the space 13*a* to fall below atmospheric pressure.

Once a sufficiently thick layer of foam 64 has accumulated in the space 13*a*, air may be blown into or allowed to flow into the interior tank space above the layer of foam 64 in a space designated by numeral 13*c* in FIG. 2. Since this air will not be exposed to the liquid 62 in the tank 10, it will not be mixed with volatile vapors and may be expelled through the conduit 58 directly to atmosphere when liquid is again reintroduced into the tank space 13.

When it is desired to fill the tank 10 with a new quantity of a liquid of the same or different type from that removed from the tank, the valve 60 is opened and air allowed to escape therethrough. As the liquid level rises, foam 64 may also be displaced through the conduit 58 and the valve 60 and flow onto the top deck 20 of the roof 16 where it will eventually dissipate and the liquid residue from the foam 64 may be drained away from the roof 16 through the aforementioned rainwater drainage system, not shown.

The foam 64 may comprise one or more non-ionic surfactants such as an alkylpolyethyleneglycol or an alkylpolyglycoside, a fluorinated surfactant such as quaternary ammonium chloride or ammonium iodide, a polymer selected from the group consisting of polysacharides, biopolymers and synthetic polymers, one or more solvents selected from the group consisting of alcohols and water. The non-ionic surfactant may be in a weight range of about 0.5 to 6 percent, the fluorinated surfactant may be in a weight range of about 0.05 to 1 percent, the solvent may be in a weight range of about 1.0 to 10.0 percent and the polymer may be in a range of about 500 to 5000 parts per million (ppm). The balance of the ingredients in the foam composition would be water.

Although preferred embodiments of the present invention have been described in detail herein, those skilled in the art will recognize that various substitutions and modifications may be made to the system and method of the invention without departing from the scope and spirit of the appended claims.

What is claimed is:

1. A method for minimizing the generation of volatile vapors in a liquid storage tank having an interior space delimited by a floating roof, said method comprising the steps of:

generating a vapor-suppressing foam; and introducing said foam into said storage tank to occupy at least a portion of said space and under said floating roof during at least one of liquid withdrawal from and introduction of liquid into said storage tank.

2. The method set forth in claim 1 wherein:

said foam is introduced into said storage tank through an opening in said floating roof to occupy said space in said storage tank between a liquid surface in said space and the underside of said floating roof.

3. The method set forth in claim 2 wherein:

said foam is generated in a foam surge tank in communication with said opening in said floating roof.

4. The method set forth in claim 1 wherein:

said foam is introduced into said storage tank under a pressure head created by said foam.

5. The method set forth in claim 1 wherein:

said foam is introduced into said storage tank by pressure air acting on said foam.

6. The method set forth in claim 1 including the step of:

providing said foam as an aqueous composition comprising a non-ionic surfactant, a fluorinated surfactant, a polymer, a solvent and water.

7. A method for minimizing the formation of volatile vapors during the withdrawal of hydrocarbon liquids and the like from a floating roof storage tank, said floating roof storage tank including a floating roof, a foam surge tank disposed on said floating roof and an opening formed in said floating roof between said surge tank and an interior space of said tank, said method comprising the steps of:

generating a quantity of foam in said surge tank until a maximum desired depth of foam in said surge tank is reached;

commencing withdrawal of liquid from said storage tank while continuing &:o generate foam at a sufficient rate to fill a space in said storage tank below said roof and above a liquid interface in said storage tank as said liquid is withdrawn; and discontinuing the injection of said foam into said surge tank.

8. The method set forth in claim 7 including the step of:

forcing said foam from said surge tank through said opening and into said space under the urging of pressure air until a blanket of foam is disposed in said space of a desired thickness.

9. The method set forth in claim 8 including the step of:

introducing pressure air into said space after discontinuing the generation of said foam and then discontinuing the generation of pressure air to allow foam in said storage tank to expand.

10. The method set forth in claim 7 including the step of:

monitoring the level of foam in said surge tank and maintaining a level of foam at a predetermined minimum in said surge tank.

11. In a floating roof storage tank for storing petroleum liquids and the like, a tank shell and a floating roof defining with said tank shell an interior space, and the improvement characterized by:

means disposed on said floating roof for generating a vapor-suppressing foam for introduction into said interior space between said floating roof and a liquid interface.

12. The improvement set forth in claim 11 wherein:

said means for generating foam includes a foam surge tank disposed on said floating roof and means forming an opening between said surge tank and said interior space of said storage tank.

13. The improvement set forth in claim 12 including:

a foam generator disposed in said surge tank and connected to a source of foam solution for generating foam in said surge tank for introduction into said storage tank.

14. The improvement set forth in claim 13 including:

a source of pressure air in communication with said surge tank for urging foam into said storage tank from said surge tank.

15. The improvement set forth in claim 14 including:

means disposed in said surge tank for indicating the level of foam in said surge tank during generation thereof.

16. The improvement set forth in claim 10 including:

means on said floating roof in communication with said interior space of said storage tank for venting foam from said storage tank.

17. In a floating roof storage tank comprising a generally cylindrical tank wall, a bottom, and a floating roof disposed for floating up and down within said tank wall to define a storage space for petroleum liquids and the like, the improvement characterized by:

a foam surge tank disposed on said floating roof and adapted to be in communication with said storage space of said storage tank;

a vapor-suppressing foam generator disposed for introducing vapor-suppressing foam into said surge tank;

conduit means connected to said foam generator and extending to a point exterior of said tank for connection to a source of foam solution; and a source of pressure air in communication with said surge tank for introducing relatively high-volume, low-pressure air into said surge tank to force foam from said surge tank into said storage tank.

18. The improvement set forth in claim 17 including:

means in said surge tank for indicating the level of vapor-suppressing foam in said surge tank during a process of introducing said foam into said storage tank to occupy at least a portion of said storage space.

* * * * *